United States Patent [19]

Fulbrook

[11] 4,131,788

[45] Dec. 26, 1978

[54] ELECTRIC HEATER

[75] Inventor: William J. Fulbrook, Chingbord, England

[73] Assignee: Hedin Limited, London, England

[21] Appl. No.: 789,704

[22] Filed: Apr. 21, 1977

[30] Foreign Application Priority Data

Apr. 28, 1976 [GB] United Kingdom ..... 17309/76

[51] Int. Cl.[2] ..... H05B 5/38

[52] U.S. Cl. ..... 219/535; 219/536; 219/528; 219/549; 24/20 EE; 24/19

[58] Field of Search ..... 219/535, 536, 528, 549, 219/311; 24/16 R, 19 R, 20 R, 20 EE

[56] References Cited

U.S. PATENT DOCUMENTS

| | | | |
|---|---|---|---|
| 1,325,395 | 12/1919 | Clegg | 24/16 R |
| 2,959,661 | 11/1960 | Bothwell et al. | 219/535 |
| 2,987,599 | 6/1961 | Voss | 219/535 |
| 2,992,314 | 7/1961 | Druggnand et al. | 219/535 |
| 3,730,373 | 5/1973 | Kozbelt | 219/535 |
| 3,829,657 | 8/1974 | Hinz | 219/535 |
| 3,872,281 | 3/1975 | Krieg et al. | 219/535 |

*Primary Examiner*—Joseph V. Truhe
*Assistant Examiner*—M. H. Paschall
*Attorney, Agent, or Firm*—Kemon & Estabrook

[57] ABSTRACT

An electrical heater for clamping round a body to be heated comprises a sheet-like elongate heating element, a housing member against which the element is located, and a continuous band of flexible metal strip formed into two closely-spaced elongate sections joined at their ends by rounded sections. The element is sandwiched between the housing member and one of the elongate sections and that section is slidably attached to the housing member. In use, the heater is located round the body with the housing member in contact with the body, and the rounded end sections of the strip are urged together, for example by a screw cooperating with rollers within the rounded sections.

4 Claims, 2 Drawing Figures

ELECTRIC HEATER

This invention relates to electrical heaters of the "band" type, i.e. heaters having an elongate flat heating element which is formed into a band and which, in use, is clamped round a cylindrical body which is to be heated.

Such heaters are extensively used in the plastics industry for the heating of moulding and extrusion machinery, for example extrusion nozzles. They are also used for heating film processing tanks and containers for hot melt adhesives, and for many other applications.

The heating element of such a heater normally comprises a length of resistance wire wound on a mica or other electrically-insulating and heat-resisting sheet, the element being enclosed in, and electrically insulated from, a metallic housing which both protects the element and serves to conduct heat from the element to the body which is to be heated.

Two types of clamping arrangements are commonly used for band heaters. In one such arrangement the ends of the housing are bent outwards, or have outwardly extending lugs attached thereto, to accept one or more clamping screws which pull the ends of the housing together. In the second arrangement a separate clamping band is fitted round the housing, and has one or more clamping screws cooperating with lugs formed on, or attached to, the clamping band.

In both cases, since the clamping effect acts primarily on the ends of the band, good thermal contact between the surface of the housing and the body to be heated cannot be ensured over the whole of the surface of the housing. In fact, some curvature of the band can occur across its width, so that even if the edges of the band are in contact with the body, the centre of the surface may be spaced away from the body. At any point at which there is not good thermal contact between the surface and the body, thermal conduction from the heater will be poor, and there will be local overheating of the wire of the element. Failure of the element at such "hot spots" is likely.

Most of the known band heaters are fairly rigid in construction, particularly those which have a thick separate clamping band. This means that such heaters have to be preformed to conform fairly closely with the outside dimensions of the body to be heated, and can, therefore, only be positioned round the body by sliding them over the end of the body. This can clearly be very inconvenient when the length of the body is considerable or when the ends of the body are inaccessible. Some of the larger diameter band heaters are sufficiently flexible to enable them to be sprung on to the body for the initial fixing, but small diameter heaters for use, for example, for extrusion nozzles, generally cannot be flexed without damaging the element.

It is an object of the present invention to provide a band heater which allows more reliable thermal contact with the body to be made over the whole of the surface of the band, and which can be sufficiently flexible to allow them to be wrapped by hand around even small diameter nozzles without any need for preforming.

According to the present invention, an electric heater comprises a sheet-like elongate heating element having first and second mutually opposite major surfaces; a metallic housing member covering the first major surface of the element; a continuous band of flexible metal strip the majority of the length of which comprises two parallel confronting substantially equal length portions, the remainder comprising two rounded portions interconnecting the parallel portions, the band being situated on the opposite side of the element to the housing member and one of the parallel portions covering the second major surface of the element and being slidably attached to the housing member; and means located at the rounded portions of the band to urge the rounded portions together when the heater is positioned, in use, round a body to be heated; the housing member then being in thermal contact with the body.

The housing member preferably has turned-over edges which engage said one parallel portion of the band to provide said slidable attachment.

One embodiment of the invention will now be described, by way of example, with reference to the accompanying drawing, in which.

Figure 1:
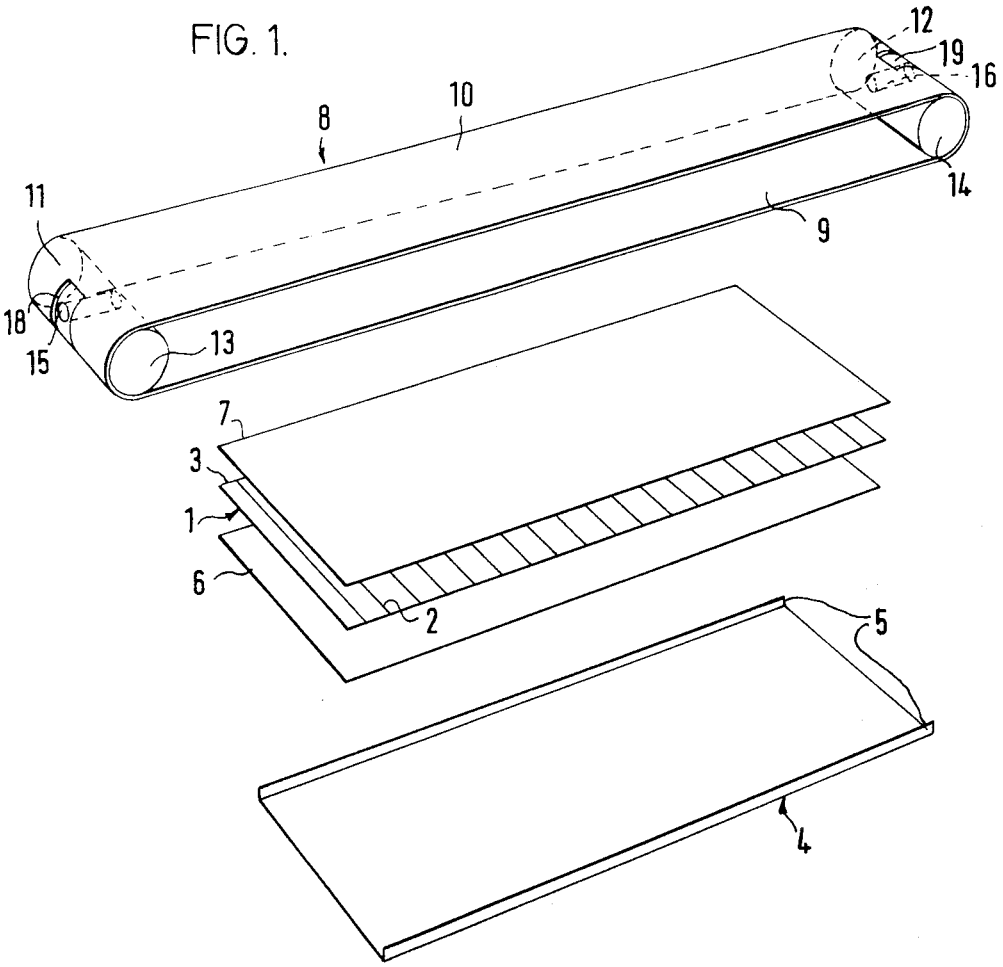
FIG. 1 is an exploded view of a heater in accordance with the invention.

In FIG. 1 a heating element 1 comprises a resistance wire 2 wound on a mica or other electrically-insulating and heat-resisting sheet 3. A metallic housing member 4, for example of 30SWG aluminium-plated or nickel-plated mild steel has turned-up edges 5 to form a trough within which the element 1 is assembled, an insulating sheet 6 (e.g. mica) being interposed between the element 1 and the member 4. A further insulating sheet 7 covers the element 1.

A continuous band 8 of thin flexible metal strip (e.g. 30SWG plated mild steel) is somewhat flatened so that its major portions 9 and 10 are parallel to each other and the band has rounded end portions 11 and 12. Into the end portions fit rollers 13 and 14 having holes 15 and 16, respectively, to receive a clamping screw 17 (not shown in FIG. 1) via cutouts 18 and 19, respectively.

During assembly of the heater, the edges 5 of the member 4 are turned down over the edges of the portion 9 of the band, so that the element 1 and its insulation sheets 6 and 7 are trapped between the member and the portion 9, the latter being to some extent slidable relative to the member 4.

Figure 2:
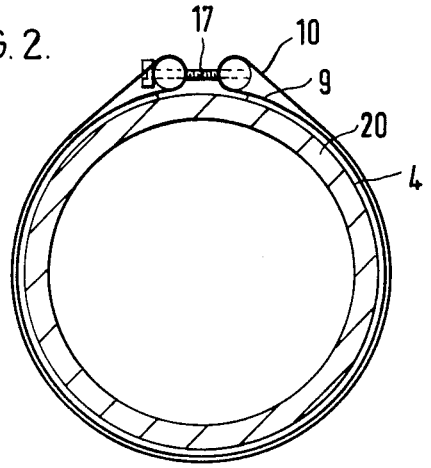
FIG. 2 is an end view showing the heater assembled round a cylindrical body which is to be heated.

Referring to FIG. 2, in use of the heater, the heater is bent round a body 20 which is to be heated, and the clamping screw 17 is tightened. The continuous band 8 can slide, as necessary, relative to the member 4 and to the rollers 13 and 14 so that the tension becomes substantially uniform throughout the band. Because the band 8 is continuous, it will be substantially entirely in tension, and can therefore be clamped extremely tightly around the element 1 and the housing member 4, and holds the member in good thermal contact with the body 20 over substantially all of the surface of the member 4. Comparison should be made with the known types of heater in which tightening of screws passing through projecting lugs merely causes bending of the lugs and localised areas of good thermal contact.

It will be apparent that in the present invention other forms of clamping fixture might be substituted in place of the rollers and associated screw, provided that the sliding of the band 8 can still take place. More than one clamping fixture may be necessary, particularly in larger sizes of heater.

Electrical connections to the heating element 1 can be in any desired form. For example, insulated (and, if necessary, armoured) lead-out wires might be brought out through holes in the band 8, or terminals might be affixed to the band and might be enclosed by a terminal housing attached to the band.

A reflector cover could, if required, be clamped round the heater or form part of the heater assembly. Such a cover would preferably comprise a metal shroud enclosing asbestos or other heat-insulating material.

One or more apertures could be provided through the band 8 to permit the insertion of thermocouples for monitoring the heater temperature.

A heater in accordance with the invention can be made thinner and more flexible than conventional heaters which do not have the continuous band clamping arrangement of the present invention.

I claim:

1. An electric heater comprising a sheet-like elongate heating element having first and second mutually opposite major surfaces; a metallic housing member covering the first major surface of the element; a continuous closed loop band of flexible metal strip the majority of the length of which comprises two parallel confronting substantially equal length portions, the remainder comprising two rounded portions interconnecting the parallel portions, the band being situated on the opposite side of the element to the housing member and one of the parallel portions covering the second major surface of the element and being slidably attached to the housing member; and means located at the rounded portions of the band to urge the rounded portions together when the heater is positioned, in use, round a body to be heated, the housing member then being in thermal contact with the body.

2. A heater as claimed in claim 1, wherein the housing member comprises a trough-like section, the edges of which are turned-over to engage said one parallel portion of the band to provide said slidable attachment.

3. A heater as claimed in claim 1, wherein the means to urge the rounded portions of the band together comprises a respective roller partly encircled by each rounded portion, and a clamping screw extending through the rollers.

4. A heater as claimed in claim 1, wherein the continuous band is formed of plated mild steel strip.

* * * * *